US005554006A

United States Patent [19]

Liao

[11] Patent Number: 5,554,006

[45] Date of Patent: Sep. 10, 1996

[54] CEILING FAN BLADE CONFIGURATION HAVING A CONCAVE BLADE PERIPHERY

[76] Inventor: Hsien-Chin Liao, No.27, Lane 228, Wen Chang Street, Nan Twen District, Taichung, Taiwan

[21] Appl. No.: 511,059

[22] Filed: Aug. 3, 1995

[51] Int. Cl.[6] ..... F04D 29/38

[52] U.S. Cl. ..... 416/235; 416/237; 416/243

[58] Field of Search ..... 416/5, 235, 237, 416/243

[56] References Cited

U.S. PATENT DOCUMENTS

| | | | |
|---|---|---|---|
| 170,893 | 12/1875 | Patterson | 416/237 |
| 201,650 | 3/1878 | Capern | 416/235 X |
| 225,493 | 3/1880 | Sherry | 416/237 |
| 1,544,134 | 6/1925 | David | 416/237 X |
| 1,597,175 | 8/1926 | Boening | 416/235 |
| 4,632,636 | 12/1986 | Smith | 416/243 |

FOREIGN PATENT DOCUMENTS

| | | | |
|---|---|---|---|
| 899180 | 12/1953 | Germany | 416/243 |

*Primary Examiner*—Edward K. Look
*Assistant Examiner*—Michael S. Lee
*Attorney, Agent, or Firm*—Charles E. Baxley, Esq.

[57] ABSTRACT

A ceiling fan blade includes a peripheral portion having two side portions and an end portion. The side portions and the end portion each includes either a concave surface or a tapered surface for decreasing a resistance to the relative wind to the ceiling fan blade and for facilitating the air circulating effect of the ceiling fan blade.

1 Claim, 7 Drawing Sheets

CEILING FAN BLADE CONFIGURATION HAVING A CONCAVE BLADE PERIPHERY

BACKGROUND OF THE INVENTION

1. Field of the Invention

The present invention relates to a fan blade, and more particularly to a ceiling fan blade configuration.

2. Description of the Prior Art

Typical ceiling fan blades comprise a fan blade body including a peripheral portion having a thickness substantially equals to that of the fan blade body such that the resistance of the fan blade relative to the relative wind is greatly increased. For typical ceiling fans employing such a ceiling fan blade, the fastest rotational speed of the ceiling fan is up to 200 rpm only. The air circulating effect of the ceiling fan is thus limited.

The present invention has arisen to mitigate and/or obviate the afore-described disadvantages of the conventional ceiling fan blades.

SUMMARY OF THE INVENTION

The primary objective of the present invention is to provide a ceiling fan blade configuration which may be provided for decreasing the wind resistance of the fan blades and for increasing the rotational speed of the ceiling fans so as to facilitate the air circulation effect.

In accordance with one aspect of the invention, there is provided a ceiling fan blade comprising a fan blade body including a peripheral portion having two side portions and an end portion, the side portions and the end portion each including a concave surface formed therein for decreasing a resistance to a relative wind to the fan blade body and for facilitating an air circulating effect of the fan blade body.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
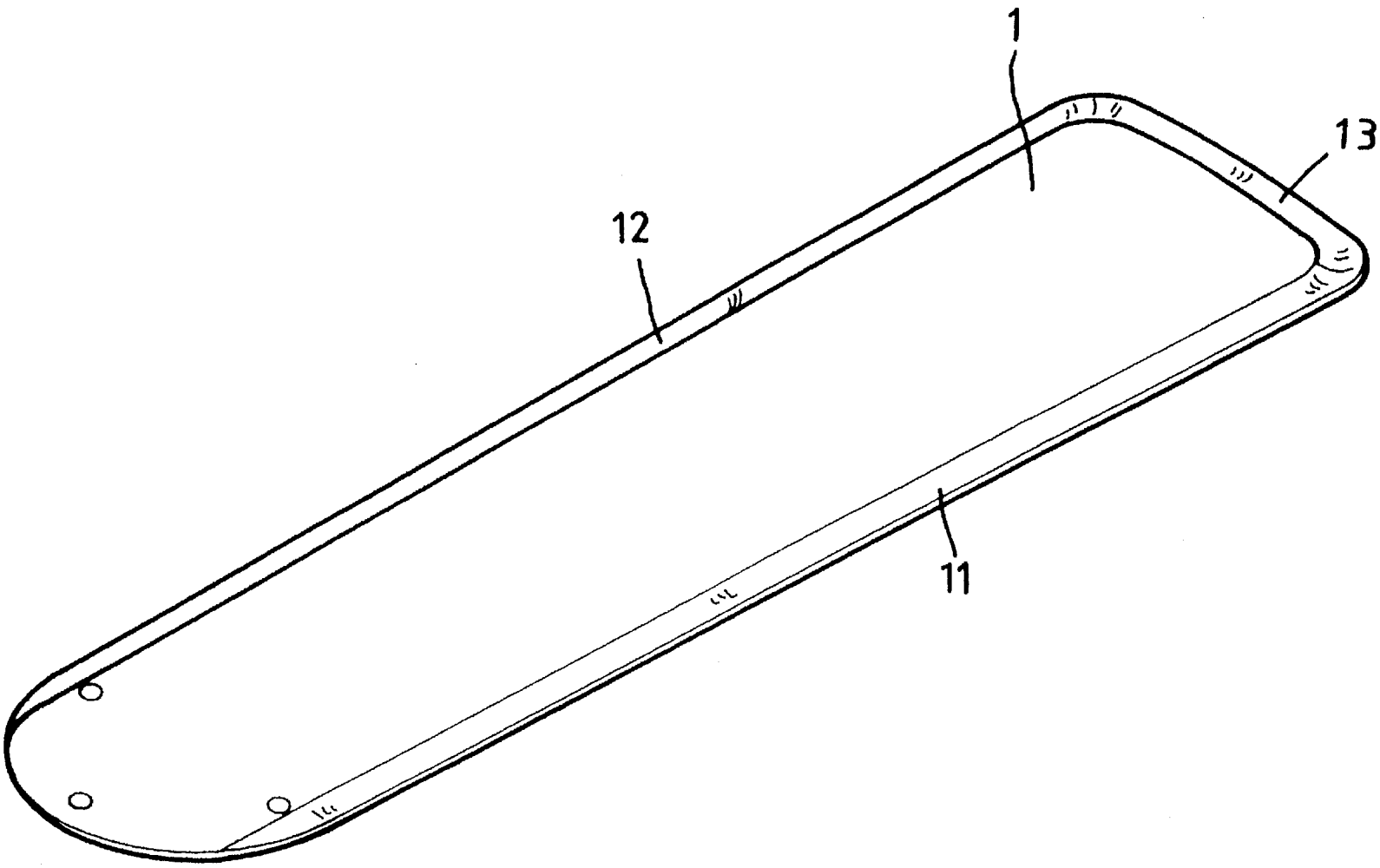
FIG. 1 is a perspective view of a ceiling fan blade in accordance with the present invention.
Figure 2:
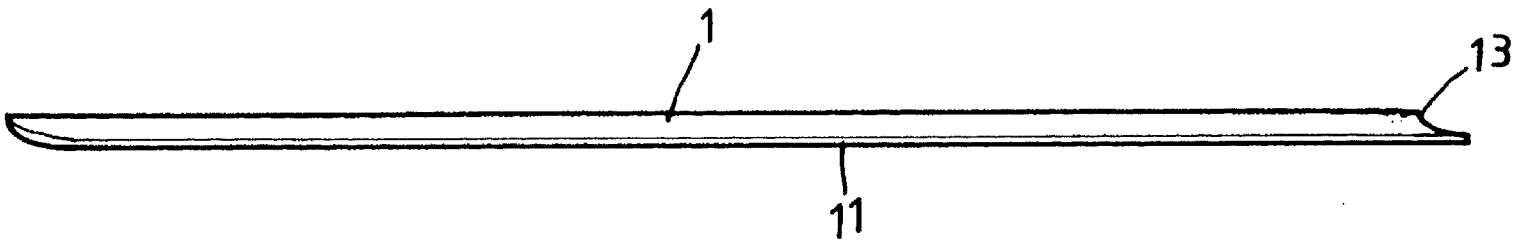
FIG. 2 is a front view of the ceiling fan blade.
Figure 3:
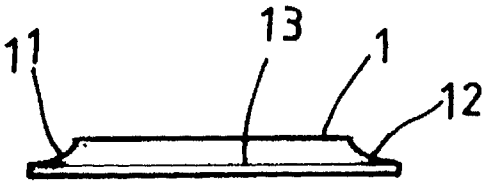
FIG. 3 is an end view of the ceiling fan blade.

Referring to FIGS. 1 to 3, a ceiling fan blade configuration in accordance with the present invention comprises a fan blade body 1 including two side edges 11, 12 and an end portion 13 each having a concave surface formed therein.

Figure 4:
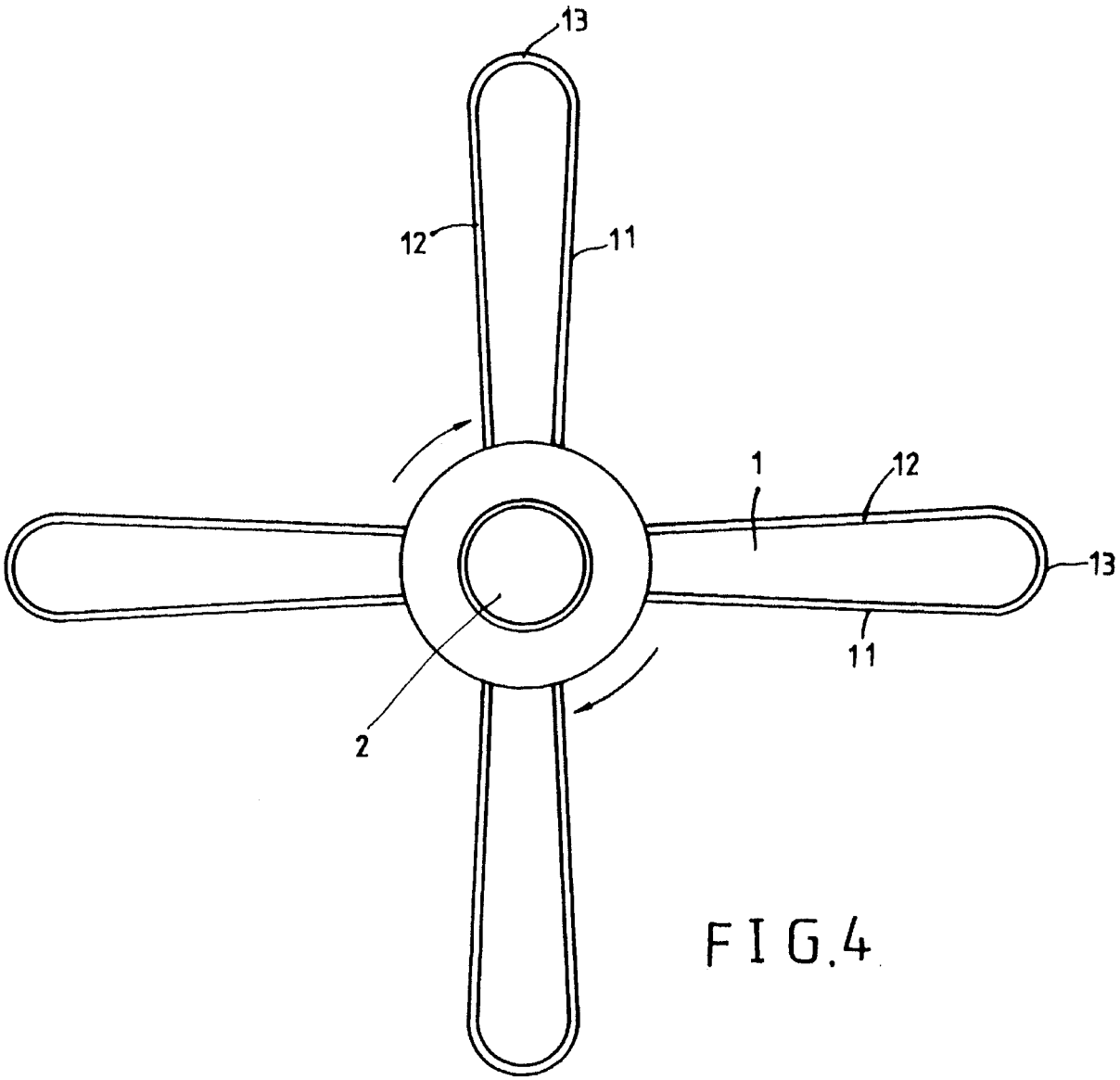
FIGS. 4 and 5 are schematic views illustrating the operations of the ceiling fan blades.
Figure 5:
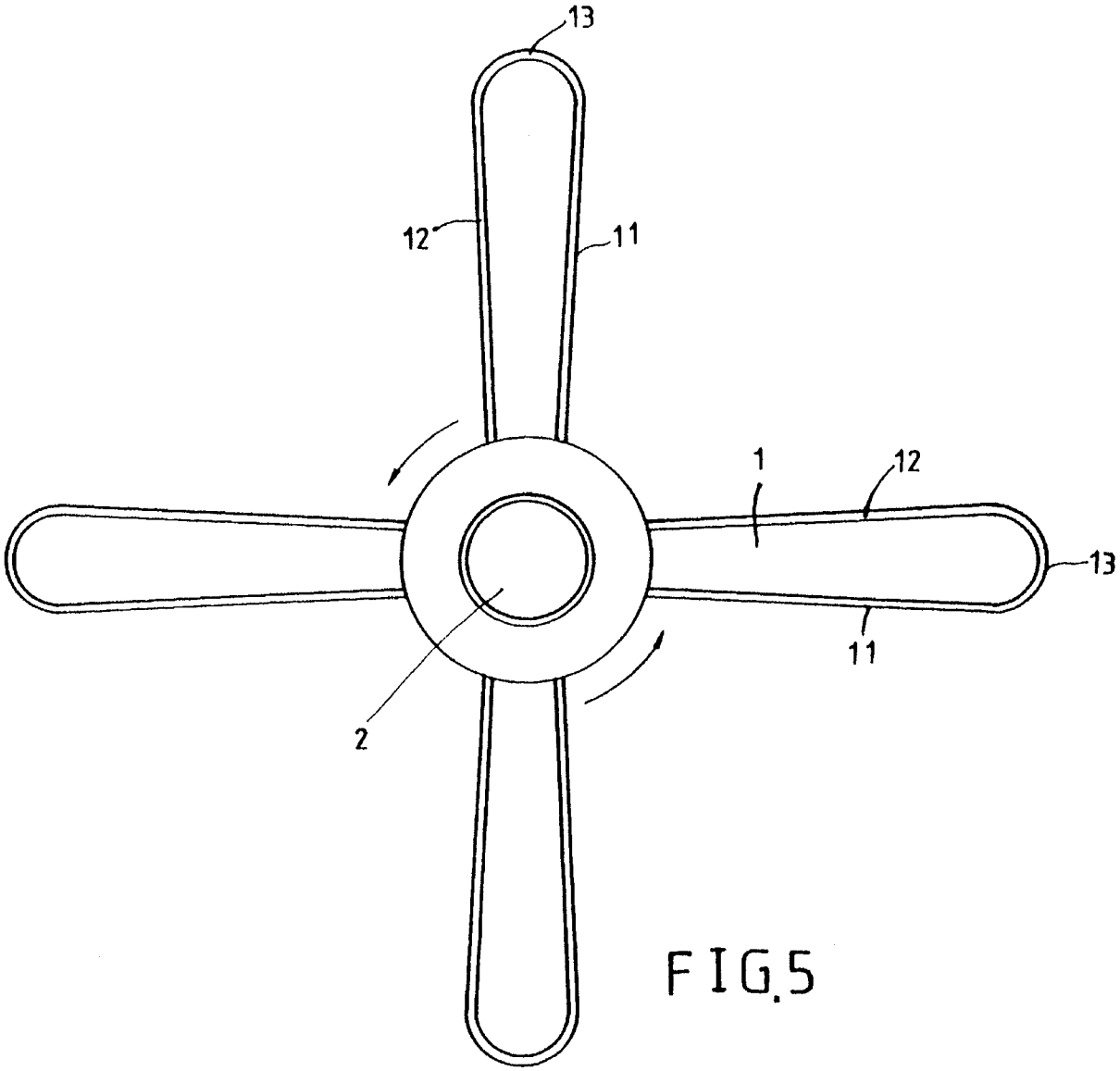
Figure 6:
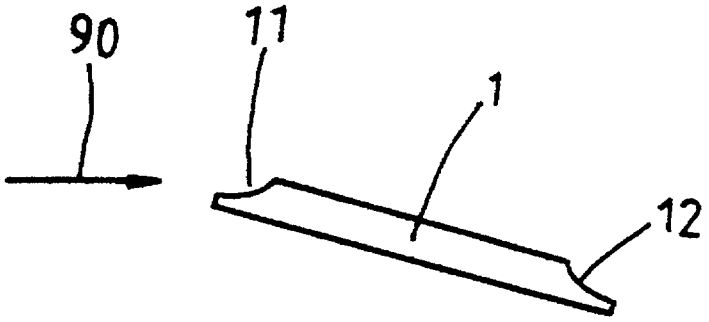
FIGS. 6 and 7 are schematic views illustrating the operation of the fan blades.
Figure 7:
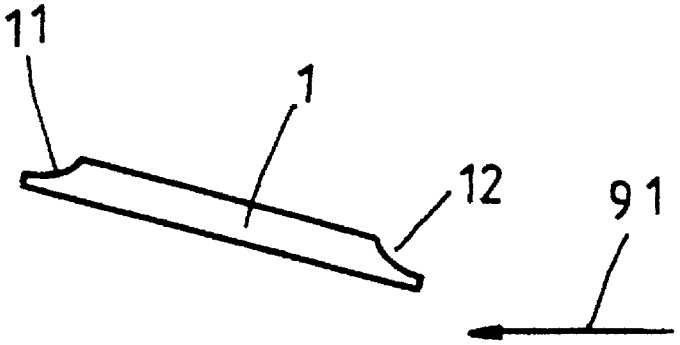

As shown in FIGS. 4 and 6, the typical ceiling fans 2 each includes four or more fan blades 1 secured thereto. The fan blades 1 each includes one side portion arranged higher than the other side portion such that the fan blades may be provided for agitating and circulating air when the fan blades are rotated by the motor of the ceiling fan. When the fan blades 1 are rotated relative to the relative wind 90 in one direction, the fan blade 1 may include a sharp edge facing toward the relative wind 90 due to the concave surface 11 of the fan blade 1. When the fan blades are rotated in the reverse direction 91 as shown in FIGS. 5 and 7, the fan blades 1 each also includes a sharp leading edge formed by the concave surface 12. The resistance of the fan blades to the relative wind may thus be decreased due to the sharp edges formed by the concave surfaces 11–13.

After testing, the ceiling fan employing the fan blades in according with the present invention may have a rotational speed up to 220 rpm which is 10% greater than that of the typical ceiling fans.

Figure 8:
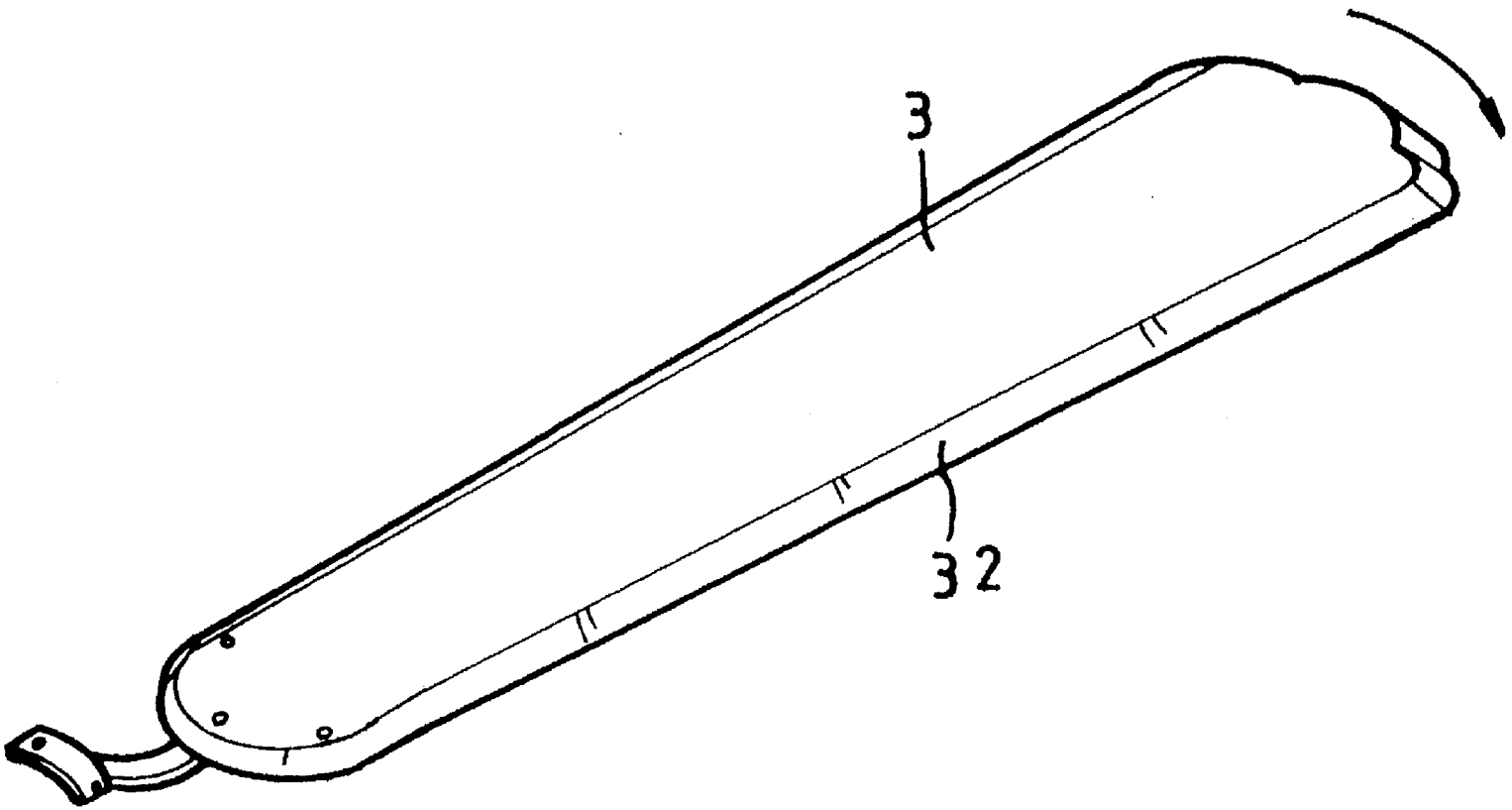
FIG. 8 is a perspective view illustrating another application of the ceiling fan blade in accordance with the present invention.
Figure 9:
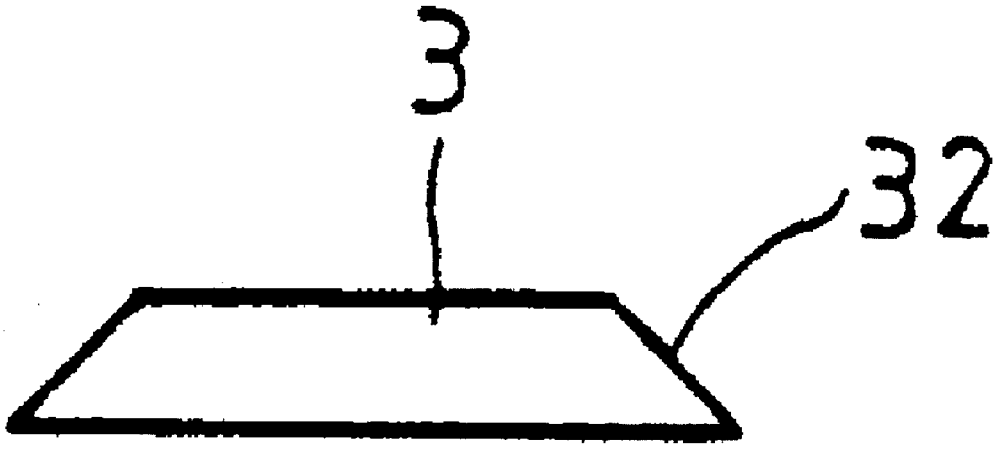
FIG. 9 is an end view of the ceiling fan blade as shown in FIG. 8.

Referring next to FIGS. 8 and 9, the fan blades 3 each includes the peripheral portion having the two side portions and the end portion. The side portions and the end portion of the fan blade each includes a tapered surface 32 formed therein for decreasing the resistance to the relative wind and for facilitating the air circulating effect.

Accordingly, the ceiling fan blade in accordance with the present invention includes peripheral portion having either a tapered surface or a concave surface formed therein so as to decrease the resistance to the relative wind and so as to facilitate the air circulating effect.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling fan blade comprising:

a fan blade body including a peripheral portion having two side portions and an end portion, said side portions and said end portion each including a concave surface formed therein for decreasing a resistance to a relative wind to said fan blade body and for facilitating an air circulating effect of said fan blade body.

* * * * *